US006387488B1

(12) United States Patent
Kumazawa et al.

(10) Patent No.: US 6,387,488 B1
(45) Date of Patent: May 14, 2002

(54) COLOR-DEVELOPING COMPOSITE SHORT FIBERS AND COLOR-DEVELOPING STRUCTURES EMPLOYING THE SAME

(75) Inventors: Kinya Kumazawa; Hiroshi Tabata, both of Kanagawa-ken; Makoto Asano; Toshimasa Kuroda, both of Osaka; Susumu Shimizu; Akio Sakihara, both of Kanagawa-ken, all of (JP)

(73) Assignees: Nissan Motor Co., Ltd., Yokohama; Teijin Limited, Osaka; Tanaka Kikinzoku Kogyo K.K., Tokyo, all of (JP)

( * ) Notice: Subject to any disclaimer, the term of this patent is extended or adjusted under 35 U.S.C. 154(b) by 0 days.

(21) Appl. No.: 09/211,193

(22) Filed: Dec. 15, 1998

(30) Foreign Application Priority Data

Dec. 25, 1997 (JP) ..... 9-366191
Oct. 7, 1998 (JP) ..... 10-299061

(51) Int. Cl.[7] ..... D02G 3/00
(52) U.S. Cl. ..... 428/359; 428/364; 428/332; 428/333; 428/401; 428/220; 428/293.4
(58) Field of Search ..... 428/373, 374, 428/293.4, 384, 359, 364, 300.7, 332, 333, 401, 297, 220

(56) References Cited

U.S. PATENT DOCUMENTS 5,472,798 A 12/1995 Kumazawa et al.
5,733,825 A * 3/1998 Martin et al. ..... 442/361
5,780,155 A * 7/1998 Ishizawa et al. ..... 428/370
5,958,548 A * 9/1999 Negola et al. ..... 428/92
6,174,603 B1 * 1/2001 Berger ..... 428/373

FOREIGN PATENT DOCUMENTS

| | | |
|---|---|---|
| EP | 0877102 | 11/1998 |
| EP | 0921217 | 6/1999 |
| WO | WO98/50609 | 11/1998 |

* cited by examiner

*Primary Examiner*—Merrick Dixon
(74) *Attorney, Agent, or Firm*—Jordan and Hamburg LLP

(57) ABSTRACT

A color-developing composite short fiber having a length of 0.01 to 100 mm is obtained by cutting a color-developing short fiber capable of reflecting visible rays and interfering with visible rays consisting of two or more kinds or polymer compounds having different refractive indices which are laminated alternately. A color-developing structure is formed by binding particles of the short fiber to one another, dispersing the short fiber in a mixture with other materials or adhering the short fiber on the surface of a support. Further, a color-developing composite short fiber having a length of 0.01 to 100 mm is obtained by cutting a color-developing composite fiber comprising two or more polymer compounds having different refractive indices which are laminated alternately forming a layer capable of reflecting visible rays and interfering therewith and a layer capable of reflecting invisible rays and interfering therewith.

16 Claims, 12 Drawing Sheets

(Crimping)

(Cutting)

(Carding)

(Needle punching)

(Embossing)

COLOR-DEVELOPING COMPOSITE SHORT FIBERS AND COLOR-DEVELOPING STRUCTURES EMPLOYING THE SAME

BACKGROUND OF THE INVENTION

1. Field of the Invention

The present invention relates generally to a fiber having a multi-ply laminar structure and to a structure employing the same, particularly to a color-developing composite short fiber which reflects visible or invisible rays and interferes with them to develop a color with high transparency and has sophisticated design and which also has excellent optical properties, and also to a color-developing structure formed by adhering the fiber on a support such as a sheet, a film or a metal plate or to a color-developing structure having the form of sheet, nonwoven fabric, paper or the like formed by binding such fibers.

2. Description of the Related Art

Recently, fibers having expressiveness such as bulkiness are being developed by using fibers with modified cross sections instead of simple round cross sections and by combining two or more kinds of fibers so as to satisfy demands for high-quality textures in fabrics, and they made entries as new fibers into the market. Fibers having more sophisticated expressiveness or functions are now in demand, and what are required of the fibers include color deepness and luster. However, if a fiber having a deep color and luster is to be obtained, an unvivid dull-colored fiber is resulted, although it may have a deep color; whereas if one tries to obtain a lustrous fiber, a gaudy glittery fiber is resulted. Accordingly, there has so far developed no technique for producing fibers fully satisfying both color depth and luster, as far as the present inventors know.

The reason is that dyes and pigments have been employed for developing colors in the prior art, and since dyes and pigments develop colors based on light absorption, the deeper is the color one tries to obtain, the smaller becomes the reflected light to cause the luster to be lost. Now, when we look around the natural world, we will find creatures satisfying both color depth and luster, for example, jewel beetles and morpho butterflies, and they have colors satisfying color depth and luster simultaneously. These creatures develop colors respectively resorting to reflection and interference of light as the mechanism of color development, and extensive studies are being made so as to find out whether this dolor-developing mechanism can be utilized in synthetic fibers.

For example, Japanese Patent Publication No. Sho 43-14185 discloses a coated three-layer composite fiber having pearl effect. It is true, however, such fibers having merely three layers may develop colors based on light reflection and interference, but the degree of color development is too limited to be able to satisfy the demands for higher expressiveness. Meanwhile, as described in Japanese Patent Publication No. Sho 60-1048, a multilayered synthetic fiber whose interfaces are all substantially parallel to one another can be obtained by combining different kinds of polymers alternately and repeatedly in a spinning pack equipped with a stationary mixer, and the resulting polymer is injected through injection orifices. In this official gazette, there is described an example of composite fiber consisting of polyethylene terephthalate and nylon 6 formed by layering them via a multilayered film component employing a stationery mixer, and this fiber can give textiles having pearl effect.

However, if a multilayered fiber is to be obtained according to this method, the laminar flow is disturbed little by little each time two polymers are combined with each other. Although a multilayered structure can be obtained somehow, this technique is not satisfactory to obtain a multilayered structure having a thickness controlled with optical accuracy. Particularly, when a multilayered structure having 10 or more layers is to be formed, polymers must be combined several times or more, so that the layers are liable to have irregular thickness giving coherent beams of light having insufficient intensity and that coherent beams of light having various wavelengths, that is to say, turbidity in color, are observed, resulting in the failure of obtaining a color having satisfactory expressiveness.

Further, Japanese Patent Publication No. Sho 57-20842 describes a static fluid mixer; and Japanese Patent Publication Nos. Sho 53-8806 and Sho 53-8807 describe methods of spinning blended yarns and apparatuses therefor. According to these methods, fibers are obtained by combining two kinds of polymers and separating them repeatedly, so that the polymers are mixed due to complication of the polymer flows to be unsuccessful in forming a multilayered structure having optical dimensions. Japanese Unexamined Patent Publication Nos. Sho 62-170510 also discloses a method for obtaining coherent beams of light by forming fine unevenness on the fiber surface. According to this method, interference of light is induced by forming a diffraction grating on the fiber. A like method is disclosed in Japanese Unexamined Patent Publication No. Hei 4-202805. In these methods, although such fibers may show color development based on interference of light, the wavelength of coherent beams of light in fabrics woven by them vary depending on the angle of view like in the thin film as described above. That is, in this case, the colors of the fabrics vary only to give cheap and unsatisfactory expressiveness.

In addition, Japanese Unexamined Patent Publication Nos. Sho 59-228042 and Sho 63-64535, Japanese Patent Publication No. Sho 60-24847, etc. propose color developing fibers and fabrics developed taking a hint from the morpho butterflies in South America which are famous for their variable color tone depending on the angle of view and bright color effect. However, the fibers employed in the inventions described in the above official gazettes are flat yarns formed by laminating different kinds of polymers together, so that it is almost impossible to obtain a thickness so as to induce interference of light even if these polymers are laminated, and such structures merely serve to control reflection of light. Meanwhile, another proposal is described in Japanese Unexamined Patent Publication No. Sho 54-42421 disclosing a method for obtaining a multi-ply lamination fiber of different kinds of polymers is disclosed. However, in this method, the laminated portion is allowed to assume a hollow annular form, and one component in the laminated portion is melted to obtain a superfine fiber. Accordingly, this proposal does not suggest such fibers as can give the effect of interference in which multiple layers are all allowed to have optical dimensions.

There is also published a technique for obtaining a material which shows color development by employing a sandwich structure of a molecule-oriented anisotropic film between a pair of polarizing films (e.g., Journal of Textile Machinery Society, Vol. 42, No. 2, p.55 (1989), and Vol. 42, No. 10, p.160 (1989), ibid.). Further, Japanese Unexamined Patent Publication Nos. Hei 7-97766 and Hei 7-97786 disclose fiber fabrics each having on the surface a light interference film provided with a substantially transparent thin film layer which can develop color with the aid of the reflected light of incident light from the front surface and the light reflected by the rear surface. Wavelength of coherent beams of light resorting to such thin films varies depending on the angle of view, so that the color of the fabric changes depending on the angle of view, only to give here again cheap expressiveness.

Under such circumstances, the present inventors was successful in enabling formation of a multilayered structure having a ply number of more than 10 so as to obtain a single color development and also in developing a composite polymer fiber which has a uniform ply thickness and a thin-layer laminar portion formed by laminating alternately two kinds of polymers which develop effective interference color, a technique for forming it and a spinneret employable for forming it, and they recently filed a patent application.

However, when a color-developing composite fiber obtained according to this technique is woven into plain weave fabric or used as stitch yarns, it is difficult to obviate torsion of the yarns and to orient accurately all of the faces exhibiting optical properties to face forward on an article. This torsion inevitably brings about reduction in chromaticity, i.e. reduction in the ability of developing the desired color which is the optical property characteristic to color-developing composite fibers. Meanwhile, the smaller is the compression rate of the cross section, the higher becomes the liability of occurrence of torsion. Further, even when the faces exhibiting optical properties are oriented accurately to face forward, their excellent optical properties can be reduced or impaired slightly if the fiber particles are overlapping one another. In other words, the chromaticity of high reflectance and high transparency can be slightly impaired.

The present invention relates to a composite fiber which maintains high reflectance and develops a color with high transparency and excellent designability, as well as, to various forms of color-developing structures (coat, resin tapes, nonwoven fabrics, etc.) utilizing the composite fiber.

SUMMARY OF THE INVENTION

Means employed for achieving the above objectives in the present invention can be divided into the following two:

The first means is a color-developing composite short fiber composed of two or more polymer compounds having different refractive indices laminated alternately which reflects visible rays and interferes with them and has a length of 0.01 to 100 mm, or a color developing structure formed by binding the fiber particles to one another, or by dispersing fiber particles in or mixing them with other materials to be bound therewith, or by adhering the fiber particles on the surface of a support. Since visible rays make colors to be perceptible to human eyes, the structures of the present invention can realize a deep and lustrous color resorting to reflection and interference of visible rays, providing excellent chromaticity.

Meanwhile, the second means is a color-developing composite short fiber, which is formed by laminating alternately two or more kinds of polymer compounds having different refractive indices, is composed of a layer which reflects visible rays and interferes therewith and a layer which reflects invisible rays and interferes therewith and has a length of 0.01 to 100 mm, and a color developing structure formed by binding the fiber particles to one another, or by dispersing fiber particles in or mixing them with other materials to be bound therewith, or by adhering the fiber particles on the surface of a support. Infrared rays are heat rays, and since reflection and interference of infrared rays mean interruption of heat rays, fiber products employing such fibers have the effect of inhibiting increase of temperatures in substances and human bodies. While ultraviolet rays are harmful to human bodies, fiber products employing the fibers of the present invention have the effect of controlling malicious influence of such rays.

These constitutions of the present invention are based on findings obtained as the result of research and development made by the present inventors so as to make better use of the characteristics of the fibers developed by them. In other words, short-cut particles of color-developing composite fiber can be distributed without causing torsion, if they are dispersed on a plate-like body. Particularly when the short-cut particles have flat cross-sections, faces exhibiting optical properties can be orientated to face forward in most particles. If the short-cut fiber particles are dispersed a little more carefully, they can also be dispersed not to overlap much. Accordingly, the problems inherent in the prior art can be solved according to such a simple technique, and effects specific to composite fibers having the optical properties as described above can fully be exhibited.

Meanwhile, in the case of non-cut long fibers, since changes in the orientation directions of the faces exhibiting optical properties is attributed to torsion, such changes occur gradually. However, in the case of short fibers which are masses of short fiber particles, the orientation directions of the fiber particles do not depend on one another, orientation directions of the faces exhibiting optical properties of adjacent fiber particles can be changed abruptly. Accordingly, in this respect, it was found that there are differences between the long fibers and short fibers in their optical properties.

As described above, short fibers can be utilized in the forms which cannot be realized by long fibers, even if they are of the same color developing fiber materials, and various forms of structures, which cannot be expected to be realized using long fibers, for example, nonwoven fabrics, paper, etc. can be formed.

Now, the color-developing composite short fiber to be provided according to the present invention will be described below in terms of its structure, production technique, characteristics, etc.

FIG. 1 shows a cross section of a color-developing composite fiber taken perpendicular to the long axis of the fiber, and the cross-sectional configuration as shown in FIG. 1 is necessary so that the fiber may exhibit the desired characteristics of reflecting and refracting visible or invisible rays according to the present invention. The fiber shown in FIG. 1(*a*) is of the structure in which two kinds of polymer compound materials having different refractive indices are merely laminated alternately; while the fiber shown in FIG. 1(*b*) is of the structure in which the laminated structure as shown in FIG. 1 is covered with one of the polymer compound materials; and the fiber shown in FIG. 1(*c*) is of the laminar structure having two kinds of ply thicknesses so as to effect reflection and interference of two kinds of rays, i.e. visible rays and invisible rays such as infrared rays. Fibers having such cross-sectional configurations are to be all included in the composite fibers to be employable for forming short fibers according to the present invention.

In order to allow these composite fibers to have actions of reflecting visible rays and interfering therewith to develop color, the cross-sectional configurations of the fibers are required to satisfy the following requirements: In the laminated portion of a fiber structure, when the optical refractive index and thickness of a high-refractive index material are na and da, and those of a low-refractive index material are nb and db, respectively, na, da, nb and db shall satisfy the following relationship: $0.38\ \mu m \leqq \lambda 1 \leqq 0.78\ \mu m$ wherein $\lambda 1=2(nada+nbdb)$, with the proviso that $1.0 \leqq na \leqq 1.8$, $1.3 \leqq nb \leqq 1.8$ μm and $1.01 \leqq nb/na \leqq 1.8$.

Here, λ1 means peak wavelengths (μm) in a reflection spectrum, and in this case the primary peak wavelength. In these expressions, nada and nbdb show "the product of optical refractive index and thickness" of the high-refractive index material and that of the low-refractive index material respectively. "The product of optical refractive index and thickness" is generally referred to as "optical thickness". Accordingly, the sum of the optical thickness of the high-refractive index material and that of the low-refractive index material multiplied by 2 give the desired peak wavelength μ1.

Meanwhile, in order to allow a layer to have actions of reflecting invisible rays such as infrared rays other than visible rays, infrared reflection and interference layer and ultraviolet reflection and interference layer should satisfy the requirements $0.78\ \mu m \leqq \lambda 1 \leqq 2\ \mu m$ and $0.2\ \mu m \leqq \lambda 1 \leqq 0.38\ \mu m$, respectively, under the above conditions.

Under the above conditions, the thicknesses of the layers are: infrared reflecting layer>visible ray reflecting layer>ultraviolet reflecting layer. Incidentally, the ply numbers N of these three layers having optical functions of reflecting visible rays, infrared rays and ultraviolet rays respectively depend on which function is selected primarily. For example, in the case where the color developing function is selected as the primary function and the other functions as secondary functions, the ply number N of the visible ray reflecting layer is increased compared with those of the reflecting layers having other functions, and thus not only the reflectance at the peak wavelength μ1 can be increased, but also the function of the layer can be improved.

Referring to the arrangement of the visible ray reflecting layer and two other invisible ray reflecting layers, in terms of the layered cross section, it may not particularly be limited, and any of these three layers may be located on the inner side. For example, when an infrared reflecting layer and an invisible ray reflecting layer are to be laminated, the thin invisible ray reflecting layer may be located on the inner side, or it may be arranged on the outer side and the infrared ray reflecting layer may be located on the inner side. Further, this fiber preferably has a cover so as to be surrounded entirely on the surface, as shown in FIG. 1(*b*). Thus, an improved fiber structure can be obtained, since the layered side faces are prevented from being exposed directly, as shown in FIG. 1(*a*), and ply separation between lamination planes can be prevented from occurring at the lamination interfaces, and abrasion resistance of the fiber can also be improved. If a material having a low melting point is used for forming the cover, it can be utilized for fusing the fiber particles on the surface of a support or fusing them with one another.

Further, referring to the cross-sectional configuration of the fiber, it is preferably of flat profile such that the faces exhibiting optical properties have larger surface area and the faces orthogonal thereto have smaller surface area. Thus, the face exhibiting optical properties can accurately be orientated to face forward and to develop a uniform color having high reflectance and transparency. However, the present invention is not to be limited to such configurations, and various kinds of cross-sectional configurations such as a square overall configuration can be employed. When a cross-sectional configuration having a low compression ratio is employed, faces other than those exhibiting optical properties are very likely to be oriented to face forward, and although it is inevitable that the fiber comes to have a high reflectance and that its transparent color is lightened, there occurs no reduction in the chromaticity as will be induced by torsion in long fibers. On the contrary, orientation directions of the faces exhibiting optical properties can rather be changed even between adjacent fiber particles, and thus the short fibers, unlike the long fibers, can exhibit merits in that it can give color-developing structures having excellent designability (decorativeness) in that the color tone varies depending on the angle of view.

Incidentally, polymer compounds employable for the fiber structures are exemplified by the following, as those for high-refractive index and low-refractive index, polymer compounds such as polyethylene, polybutylene, polyester, polyacrylonitrile, polystyrene, polyamide, polyolefin, polyvinyl alcohol, polycarbonate, methyl polymethacrylate, polyether ether ketone, polyparaphenylene terephthalamide and polyphenylene sulfide as single substances; blends of these compounds; or copolymers of two of more kinds. Further, low-refractive index polymer compounds can be exemplified by fluoroplastics, whereas high-refractive index polymer compounds can be exemplified by resins such as polyvinylidene chloride, polyethylene terephthalate and polyethylene naphthalate, and polyphenylene sulfide. Suitable combinations of low-refractive index polymer compounds and high-refractive index polymer compounds include combinations of the former compound selected from fluoroplastics and the latter compound selected from polyvinylidene chloride, polyester resins and polyphenylene sulfide.

Next, the length of the composite fiber will be described. FIG. 2 shows a composite short fiber for helping better understanding of the present invention, and this short fiber is formed by cutting a composite fiber.

In the color-developing composite short fiber according to the present invention, while the fiber is required to have a length in the range of 0.01 to 100 mm, the preferred range of length varies depending on the kind of structure to be formed employing the short fiber. For example, when the composite short fiber is used in the form of dispersion in or mixture with other materials such as coating material, the fiber conveniently has a length in the range of 0.01 to 2 mm. When the composite short fiber is used in the form of dispersion in or mixture with a coating material or the like, short fibers longer than the specified range will undergo torsion during dispersion to be liable to be bent, and color-development is hindered at such distorted portions, while color changes at the bent portions due to change in the structure. In the case of the short fiber having a length of 2 mm or shorter, even when the short fiber of the present invention is mixed with an adhesive and the resulting mixture is sprayed, clogging of spray nozzle does not occur, facilitating the operation. Meanwhile, in the case of the short fiber which is shorter than the specified range, it is technically difficult to cut a fiber material into fiber particles having a suitable size and suitable state in a large amount, leading to cost elevation. Consequently, the cut edges of the short fiber particles are deformed by the shear as shown in FIG. 2 to have no flat end which develop the original color of the fiber, and the color to be developed is changed.

On the other hand, when short fiber pieces are to be intertwined and bound to one another like in a nonwoven fabric, the short fiber suitably has a length of 2 to 30 mm.

Next, configuration and production techniques of a color-developing structure formed by adhering the short fiber of the present invention on the surface of a support such as a sheet and a metal plate, a color-developing structure such as a sheet formed using a binder resin in which the short fiber of the present invention is dispersed, a nonwoven fabric formed by intertwining the short fiber of the present invention, and a paper formed by dispersing in a paper raw material and bound therewith will be described below.

First, the color-developing structure formed by adhering the short fiber of the present invention on the surface of a support such as a sheet can be obtained by dispersing the short fiber by means of spraying or sprinkling utilizing the gravity and the like over the surface of the support which is coated on the surface with a material having adherence such as an uncured adhesive or coating to be adhered thereon, followed by curing of the uncured material. When the short fiber is to be applied over the entire surface of the support, a material having adherence may be applied over the entire surface of the support. However, for example, when a special pattern or the like is to be formed locally, an adhesive is applied patternwise beforehand, and the short fiber is dispersed on the surface of the adhesive layer thus formed, and after solidification of the adhesive, the short fiber present on the other portions of the support having no adhesive layer is removed to give the desired neat chromatic pattern.

The material of the support on which the short fiber is bonded may not particularly be limited, and various materials such as metals, wood, plastics, rubbers, ceramics, paper, fibers and glass can be employed, which may be employed not only singly but also as a mixture or laminate of two of more kinds. While the support may suitably be in the form of thin plate or thick plate, such as a film, a sheet or a plate, it may not necessarily be limited to plate-like bodies and may be of various kinds of three-dimensional structures. For example, patterns can be formed on toys using the short fiber, and articles whose designability and chromaticity are matters of great importance in daily lives can be decorated with the short fibers to make much of the characteristics of the short fibers. In the case of the structure employing the composite short fiber having the actions of reflecting both visible rays and invisible rays (e.g., infrared rays) and interfering therewith as set forth in the appended claim 2, the color-developing structure product obtained using as the support a fabric, a metal plate or the like can exhibit excellent chromaticity and also can inhibit temperature rise.

Meanwhile, if the color-developing structure is formed using as the plate-like support a transparent sheet 49 having a wavy surface as shown in FIG. 3, there is obtained a color-developing structure of excellent designability in that the orientation directions of the faces having optical properties are delicately changed following the wave to vary the color tone to be developed delicately. Otherwise, the wavy surface may be oriented not to be exposed but to be the rear side, and thus the surface of the structure can securely be prevented from being soiled or damaged. It is also possible to control securely damage, soiling, etc. of the structure by applying a transparent sheet layer or forming a transparent coating layer on the surface of the support on which the color-developing short fiber is adhered as shown in FIGS. 4(*b*) and 4(C). In the case of the former, since the surface of the structure can be flattened, it can be desoiled easily by wiping. The resulting sheet-like color-developing structure can be applied easily to various kinds of articles if an adhesive layer is formed on the rear side of the structure to readily exhibit fully its optical properties.

Further, this short fiber can be used in combination with other surface decorating materials such as coating materials. In such a case, the short fiber may first be bonded to a support, followed by coating of the resulting support with a coating material. Otherwise, a coating material may first be applied to the support, followed by dispersion of the short fiber before the coating material is dried to bind the short fiber onto the support with the aid of the adhesion of the coating material. Further, the short fiber may be used in the form of mixture with an adhesive or a coating material, and the resulting mixture can be sprayed. As the coating material to be employed here, those which do not affect color-developing properties of the short fiber are preferably selected. Particularly, when orientation of the color-developing surface characteristic to the short fibers is not very important, mixing of the short fibers with coating materials presents no problem, and further the short fiber can be used in the form of mixture with various kinds of materials which are required to develop color.

Next, nonwoven fabric consisting only of color-developing composite fiber particles which are bound to one another, paper obtained by dispersing the short fiber particles in and bound with other paper materials, and the like can be prepared in the following manner.

A composite fiber filament is first cut into particles of several millimeters, and the fiber particles are dispersed homogeneously in a paper-making raw material mixture containing water, a dispersant, a precipitant and a glue. Subsequently, the resulting dispersion is applied to the same paper-making equipment having at the bottom a fine mesh as used in ordinary paper making to prepare a wet paper sheet, followed by drying to give a paper sheet as a final product containing the color-developing composite short fiber dispersed therein. Meanwhile, after the composite fiber filament is cut into particles of several millimeters, the fiber particles are dispersed homogeneously in a binder resin solution, and the resulting dispersion is made into the form of sheet or film. If an adhesive layer is formed on one side of the sheet obtained, it can be applied to various kinds of articles easily.

BRIED DESCRIPTION OF THE DRAWINGS

FIG. 1 shows cross-sections of composite fiber structures before cut into the form of short fibers according to the present invention taken vertical to the longitudinal axes of the structures, in which:

FIG. 1(*a*) is of the structure where a high-refractive index material and a low-refractive index material are laminated alternately;

FIGS. 1(*b*) is of the structure where two polymer materials are laminated alternately, and this multilayered structure is covered entirely with one of the polymer materials so that the layered faces may not be exposed; and FIG. 1(*c*) shows a laminar structure having two kinds of ply thicknesses, i.e. a thick central layer as an infrared reflection and interference layer and visible ray reflection and interference layer as outer layers;

FIG. 5 shows a pair of nozzle plates 1,1' combined to each other to be attached to a spinneret for spinning the composite fiber, in which:

FIG. 5(*a*) is a plan view of the combined pair of nozzle plates 1,1';

FIG. 5(*b*) is a front view;

FIG. 5(*c*) is a cross-sectional view taken along the line X–X' in FIG. 5(*b*); and FIG. 5(*d*) is a cross-sectional view taken along the line Y–Y' in FIG. 5(*b*);

FIG. 6 shows how the layered cross-section of the composite fiber changes in the spinneret, in which:

FIG. 6(*a*) shows the structure of the composite fiber immediately after passing through openings 2,2' of the nozzle plates; and FIG. 6(*b*) shows the structure of the composite fiber squeezed by passing through a funnel-like portion 4;

Figure 1A:
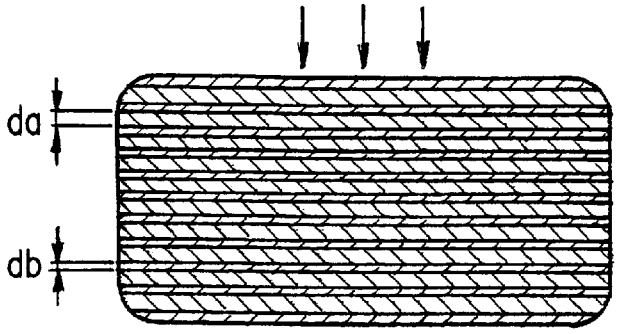
Figure 1B:
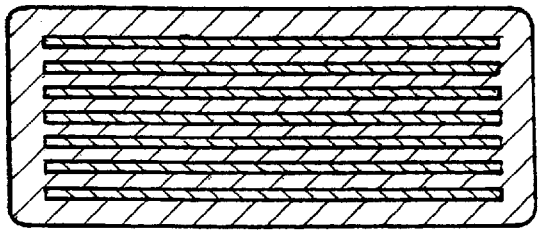
Figure 1C:
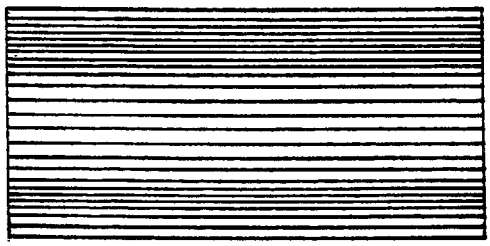
Figure 2:
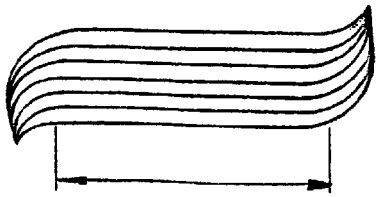
FIG. 2 shows a short fiber formed by cutting the composite fiber and the state where the cut planes (side edges) are deformed by cutting.
Figure 3:
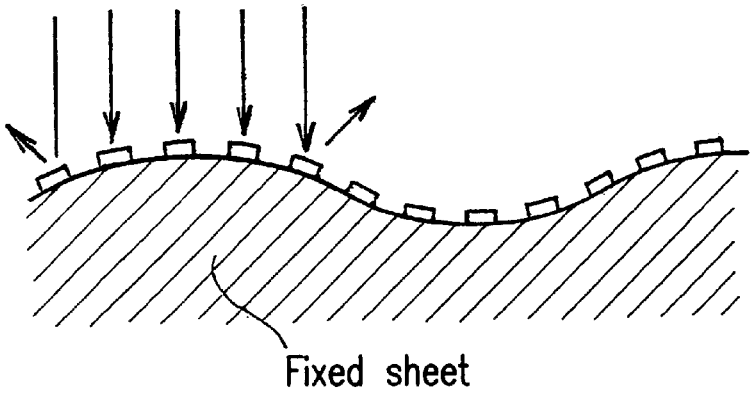
FIG. 3 is a cross section of the color-developing structure according to the present invention showing the orientation direction of the faces having optical properties of the fiber which are bound to a transparent sheet support having a wavy surface.
Figure 4A:
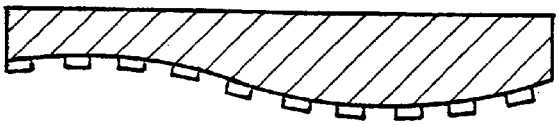
FIG. 4 shows a cross section of the color developing structure according to another embodiment of the present invention employing a transparent sheet support having a wavy surface.
Figure 4B:
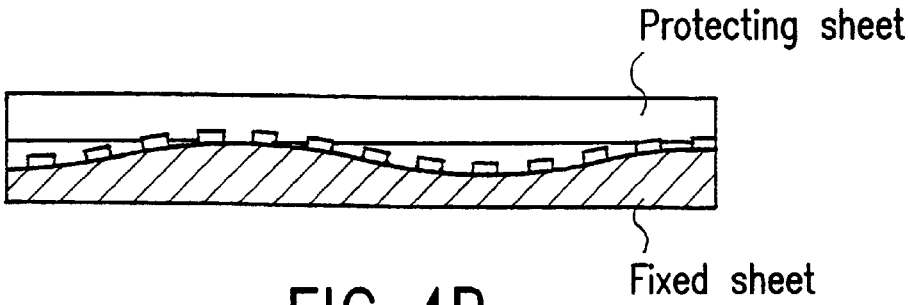
Figure 4C:
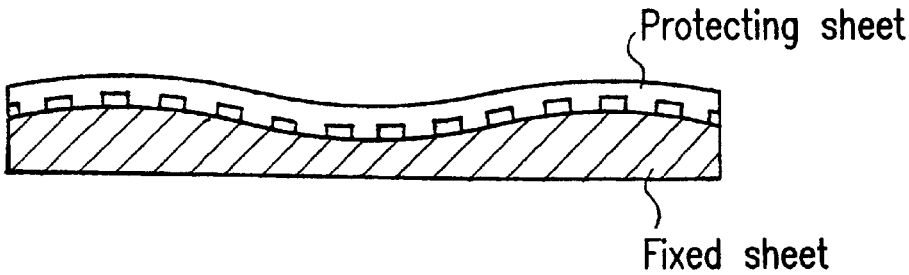
Figure 5A:
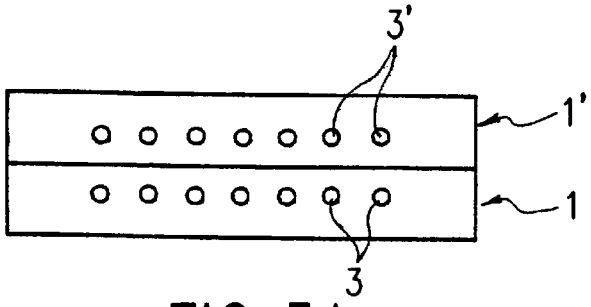
Figure 5B:
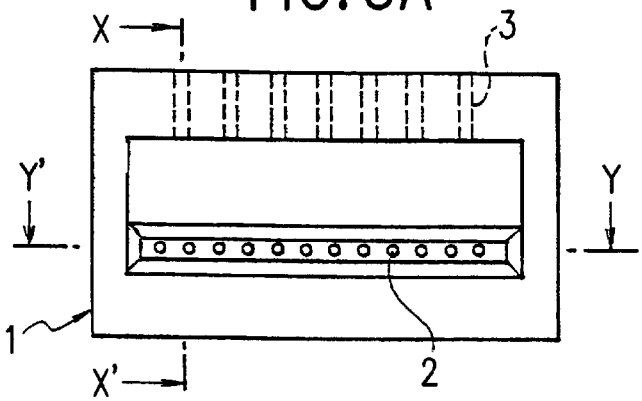
Figure 5C:
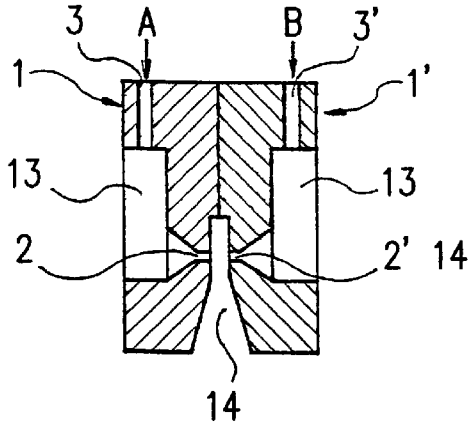
Figure 5D:
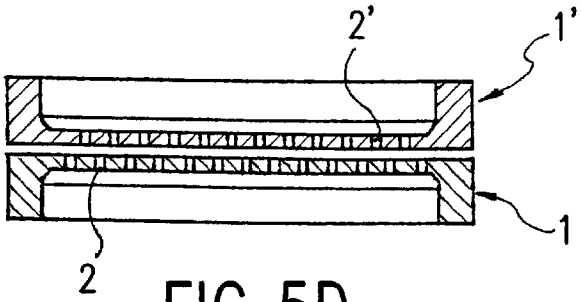
Figure 10:
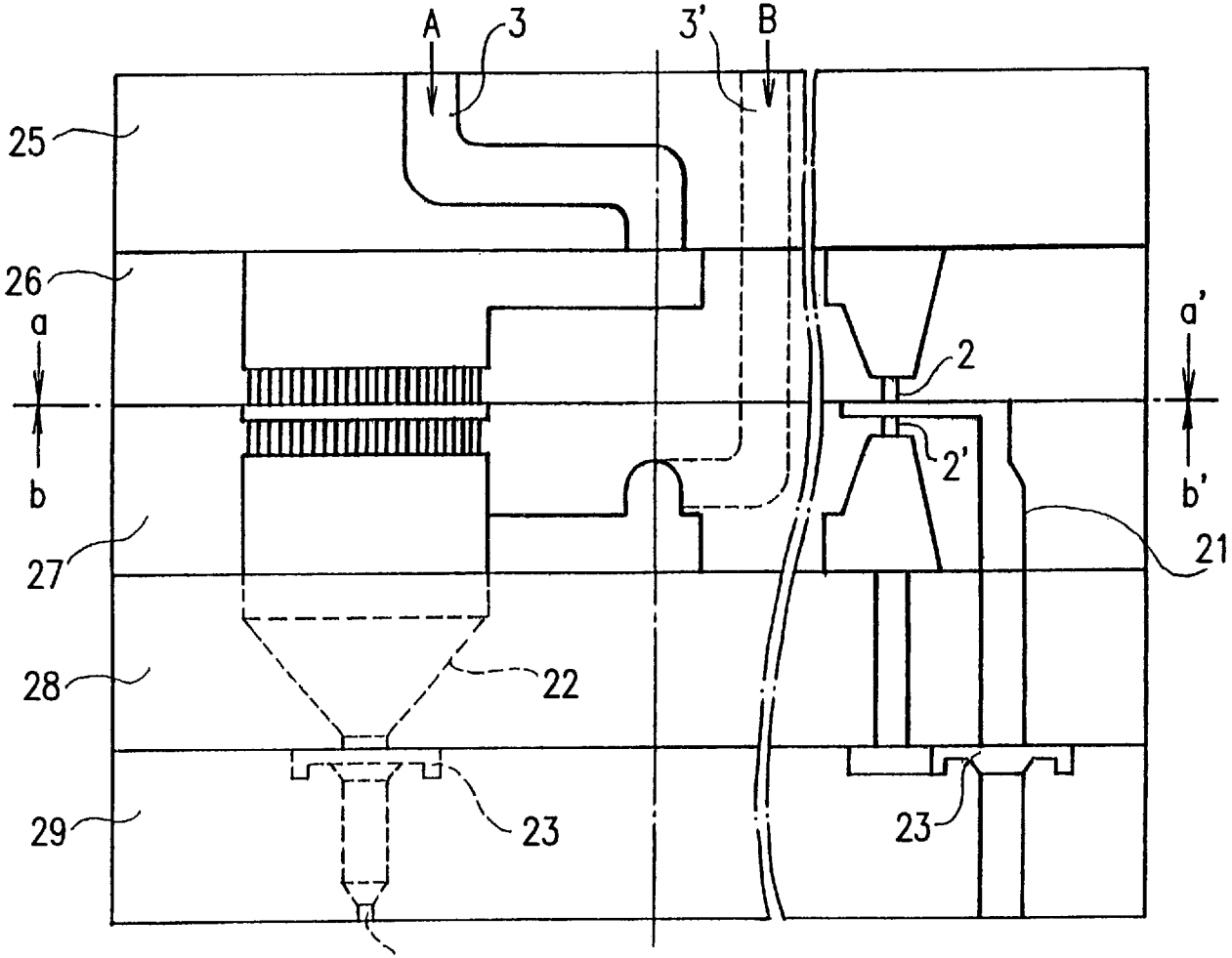
Figure 11:
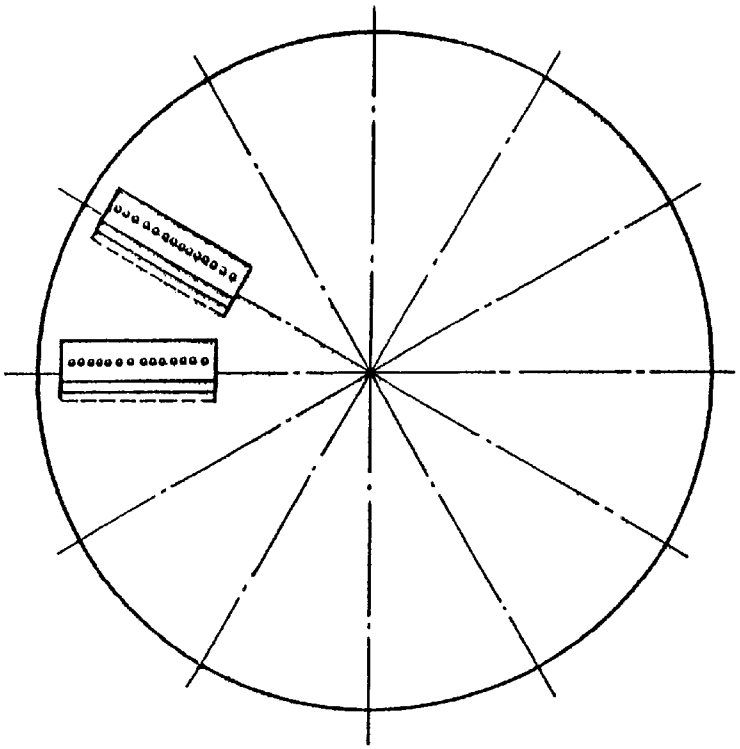
Figure 12:
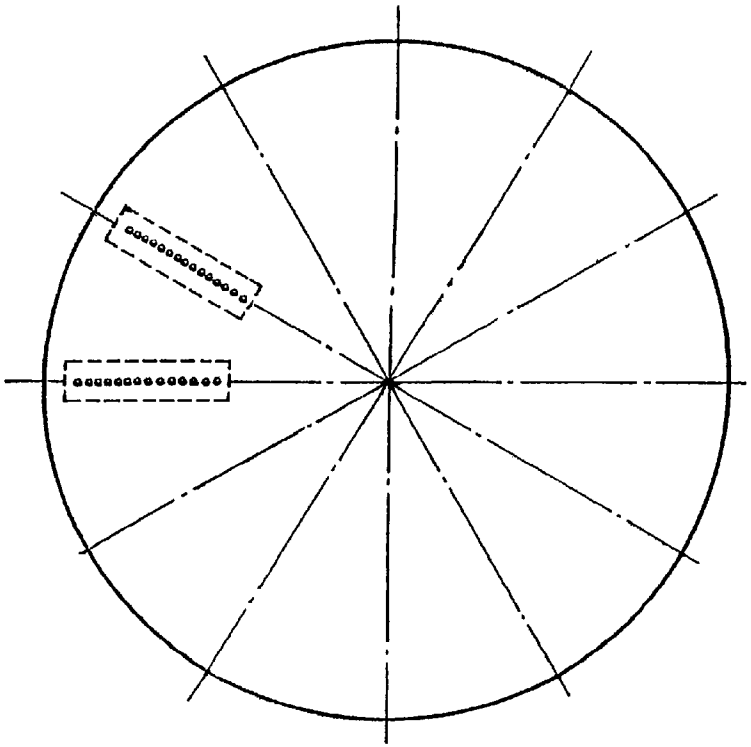
Figure 13A:
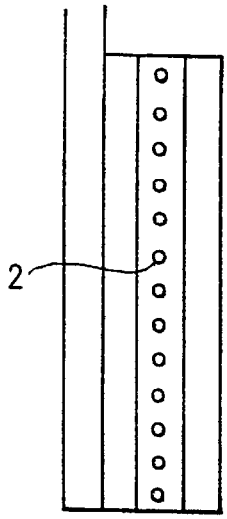
Figure 13B:
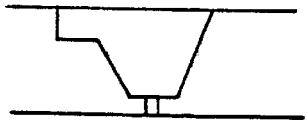
Figure 14A:
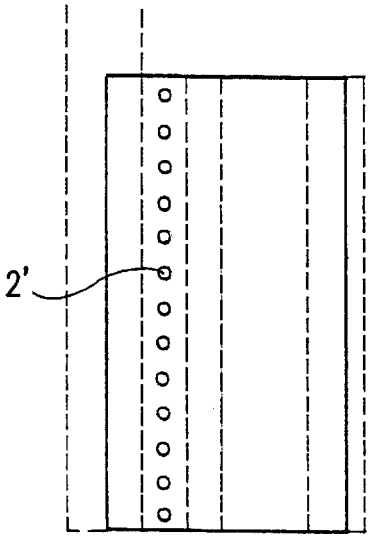
Figure 14B:
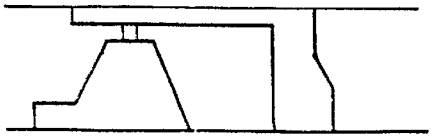
Figure 15A:
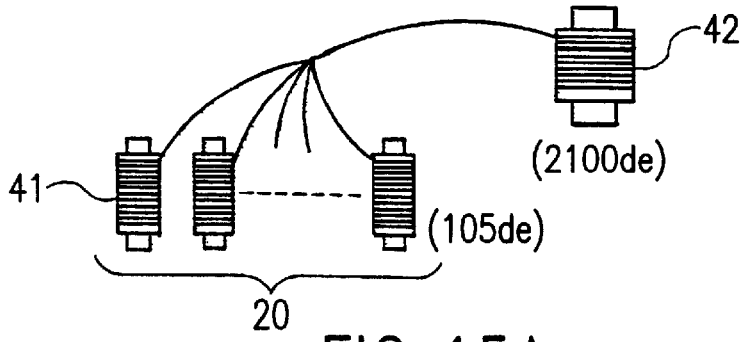
Figure 15B:
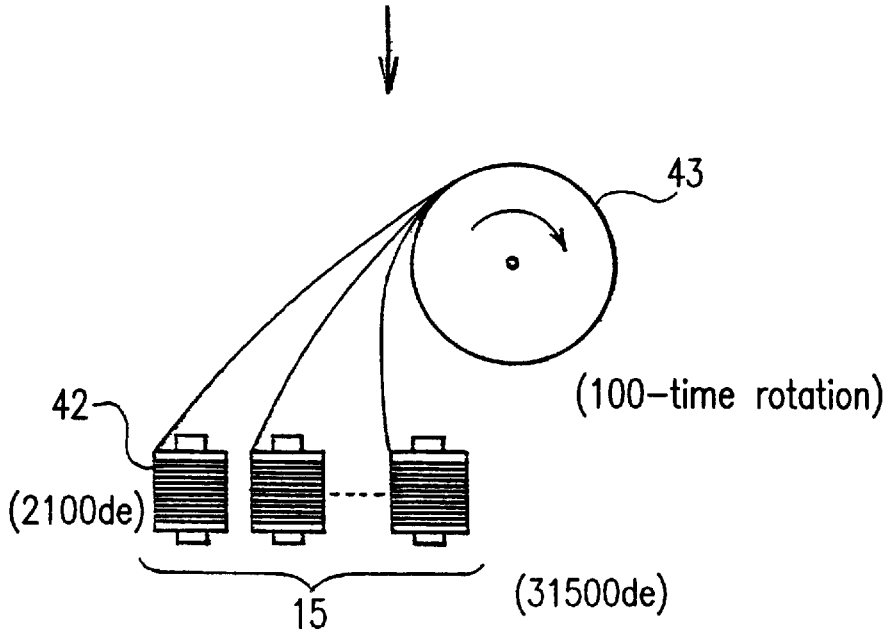
Figure 15C:
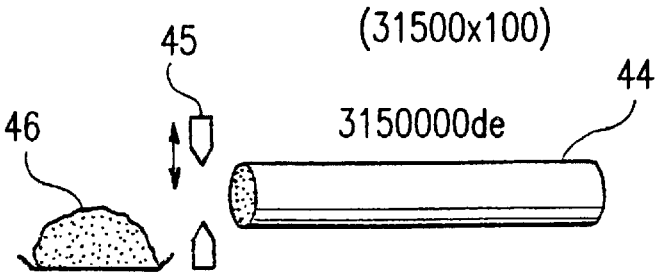
Figure 16:
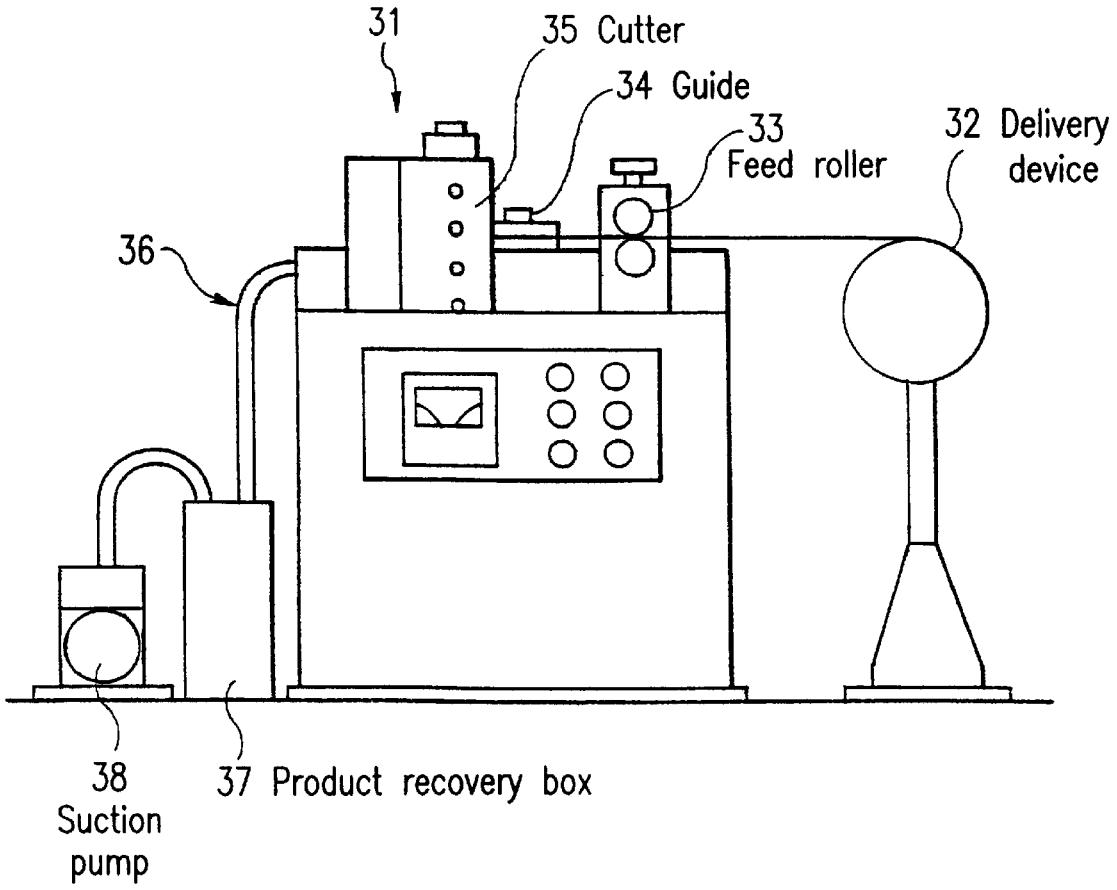
Figure 17A:
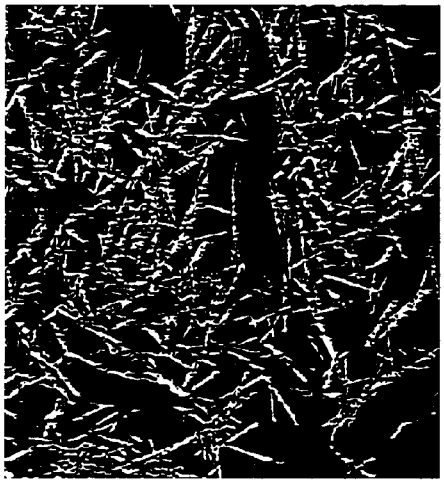
Figure 17B:
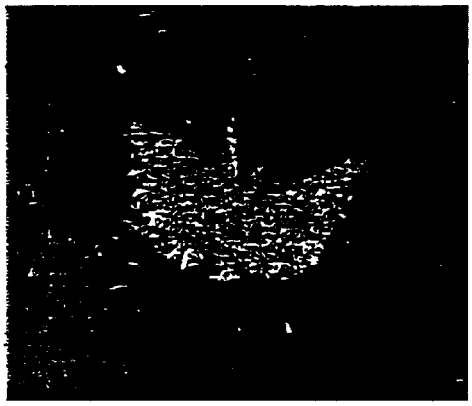
Figure 17C:
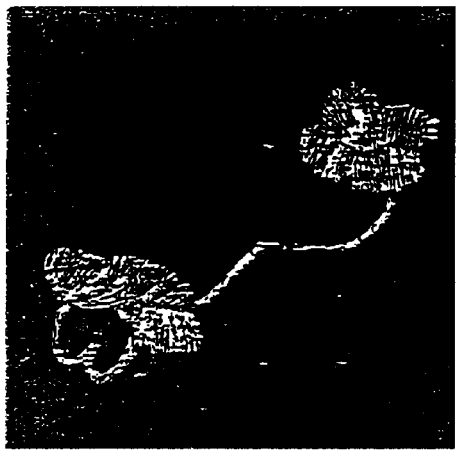
Figure 18A:
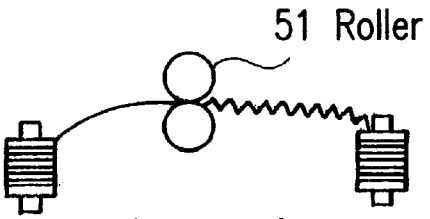
Figure 18B:
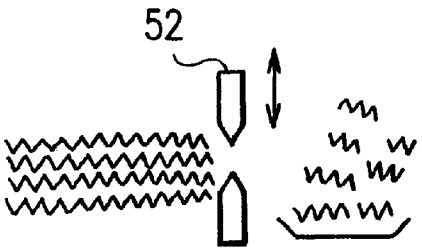
Figure 18C:
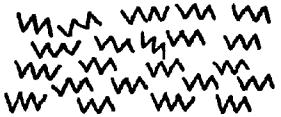
Figure 18D:
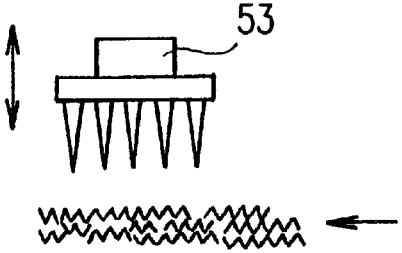
Figure 18E:
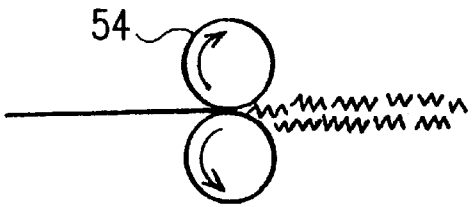

FIG. 10 shows the spinneret according to another embodiment of the present invention, that is, an overall vertical cross-sectional view of a cylindrical spinneret 60 taken along the longitudinal axis, which is suitably employed for spinning a composite fiber having the cross-sectional configuration as shown in FIG. 1(*b*); the right half and the left half of the drawing showing cross sections taken along different lines;

FIG. 11 is a view taken along the line a–a' of FIG. 10 between an upper distribution disc and a lower distribution disc of the spinneret;

FIG. 12 is a view taken along the line b–b' of FIG. 10 between an upper distribution disc and a lower distribution disc of the spinneret;

FIG. 13 shows an upper distribution disc 26 of the spinneret shown in FIG. 10, in which:

FIG. 13(*a*) is an enlarged cross-sectional view a of the left half of the upper distribution disc 26 taken along the line a–a' of FIG. 10; and FIG. 13(*b*) is a vertical cross-sectional view of the same part, i.e. the upper distribution disc;

FIG. 14 shows a lower distribution disc 27 of the spinneret shown in FIG. 10, in which:

FIG. 14(*a*) is an enlarged cross-sectional view a' of the right half of the lower distribution disc taken along the line a–a' of FIG. 10; and FIG. 14(*b*) is a vertical cross-sectional view of the same part, i.e., the lower distribution disc;

FIG. 15 illustrates an example of the technique of mass-producing a short fiber;

FIG. 16 is a schematic drawing of a high-speed cutting machine employed for cutting the composite fiber;

FIG. 17 show duplicates of pictures illustrating black panels on which short fibers are adhered with an adhesive, in which:

FIG. 17(*a*) is a duplicate of a picture showing a black panel on which the short fiber is dispersed over the entire surface;

FIG. 17(*b*) is a duplicate of a picture showing a black panel on which an adhesive is applied patternwise with the short fiber being dispersed on the adhesive layer; and FIG. 17(*c*) is a duplicate of a picture of an embroidered pattern using the composite fiber structures as stitch yarns for comparison; and FIG. 18 shows a process for producing a nonwoven fabric according to the present invention.

DESCRIPTION OF THE PREFERRED EMBODIMENTS (1) Spinning of Color-developing Composite Fiber A process for producing a composite fiber having such characteristics will first be described below specifically.

Figure 7:
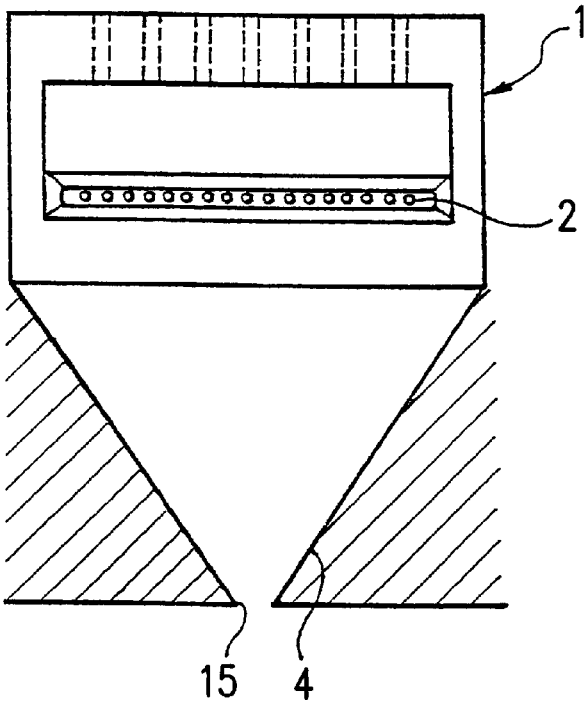
FIG. 7 shows in cross-sectional view the nozzle plates and a funnel-like portion 4 contiguous thereto.

FIG. 5 shows a combined pair of nozzle plates 1,1' of a spinneret for spinning a composite fiber having the cross-sectional configuration as shown in FIG. 1(*a*). FIG. 5(*a*) is a plan view of the combined pair of nozzle plates; FIG. 5(*b*) is a front view; FIG. 5(*c*) is a cross-sectional view taken along the line X–X' in FIG. 5(*b*); and FIG. 5(*d*) is a cross-sectional view taken along the line Y–Y' in FIG. 5(*b*). When introduced through inlets 3,3' defined at the tops of the nozzle plates 1,1' and fed to nozzle plate chambers 13,13', two kinds of molten polymer materials A and By are injected out of a row of openings 2,2' defined in the nozzle plates 1,1' respectively, and the thus injected two molten polymer materials are fed forward in the form of laminate of the molten polymer materials A and B to a meeting chamber 14. The channel following contiguous to the pair of nozzle plates is a funnel-like portion 4 having at the lower end an outlet, as shown in FIG. 7.

Figure 6A:
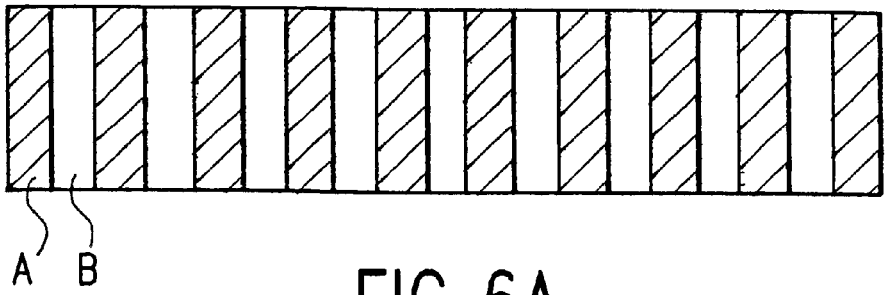
Figure 6B:
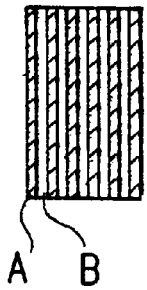
Figure 8:
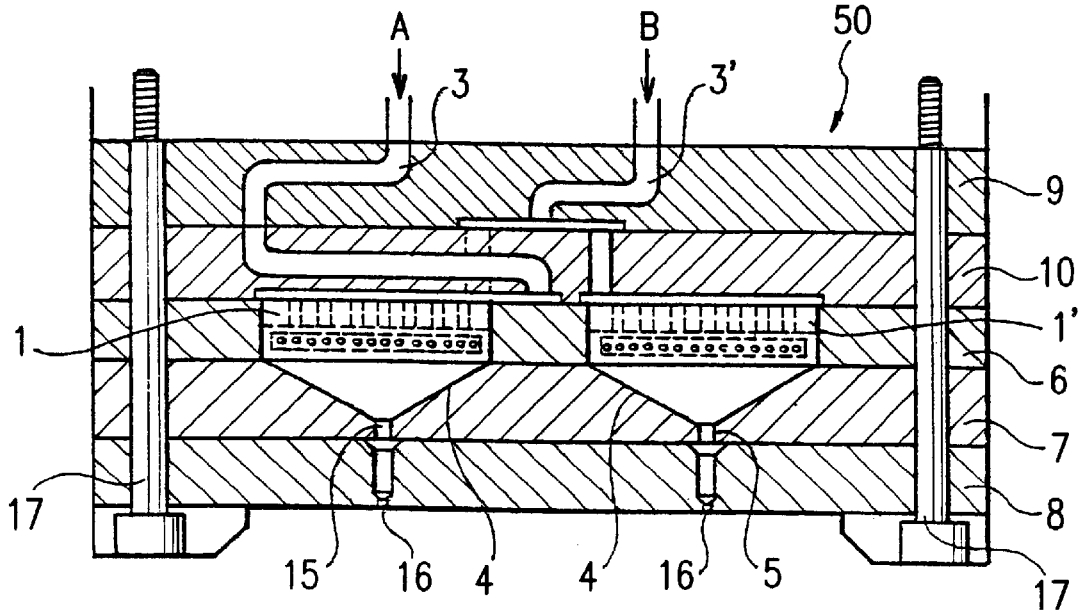
FIG. 8 shows an overall vertical cross-sectional view of a disc-like spinneret 50 incorporated with the nozzle plates taken along the longitudinal axis.
Figure 9:
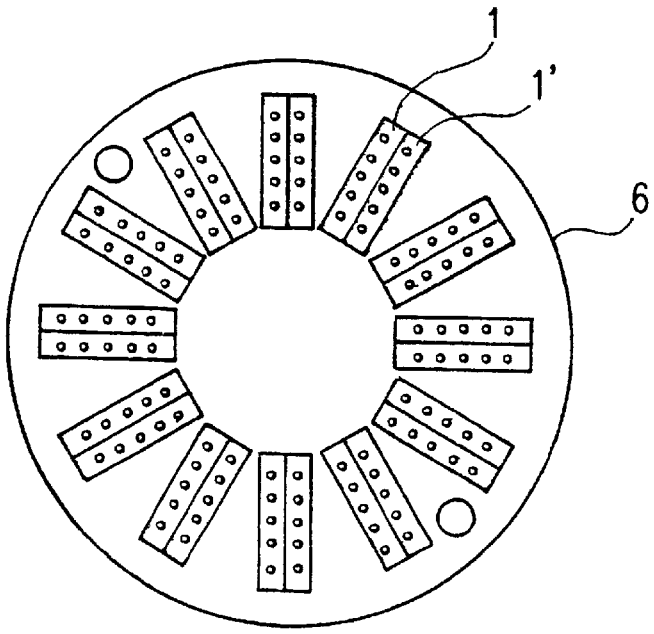
FIG. 9 is a plan view of an upper spinneret disc of the spinneret 50.

FIG. 8 shows an actual spinneret 50 incorporated with such nozzle plates. The spinneret 50 consists of an upper distribution disc 9, a lower distribution disc 10, an upper spinneret disc 6, an intermediate spinneret disc 7 and a lower spinneret disc 8 which discs are all fastened with bolts 17. The upper spinneret disc 6 contains a multiplicity of nozzle plates which are arranged radially as shown in FIG. 9, and the same number of inlets 3,3' as that of the nozzle pairs are defined in the upper distribution disc 9 and the lower distribution disc 10 so as to supply the molten polymer materials A and B to each pair of nozzle plates 1,1', while the same number of funnel-like portions 4 and the same number of outlets 15 as that of the nozzle plate pairs are defined in the intermediate spinneret disc 7 and the lower spinneret disc 8 so as to allow composite polymer fibers to be formed in the respective nozzle plates may have the configuration as shown in FIG. 6(*b*).

To describe formation of a composite fiber structure using this spinneret 50, the molten polymer material A is first distributed through the inlets 3 defined in the upper distribution disc 9 and the lower distribution disc 10 to the nozzle plates 1, and the molten polymer material B is likewise distributed through the channels 3' to the nozzle plates 1'. Subsequently, the polymer materials A and B are injected through the openings 2,2' of the nozzle plates 1,1', respectively, to be laminated with each other, and the thus laminated polymer is injected through the outlets 15 to be spun through final spinneret orifices 16 to provide composite fibers which are of high reflectance and can develop colors with high transparency.

When a composite fiber structure having the cross-sectional configuration as shown in FIG. 1(*c*), i.e., a fiber structure having a visible ray reflection and interference layer and an invisible ray reflection and interference layer is to be formed, it can be realized by employing nozzle plates 1,1' each having two kinds of opening diameters, although the method therefor will not specifically be described here. For example, there may arranged large-diameter openings in the central area and small-diameter openings on each side area.

FIGS. 10 to 14 illustrate a spinneret 60 which is suitable for forming composite fiber structures having the cross-sectional configuration as shown in FIGS. 1(*b*). This spinneret 60 consists of an introduction disc 25, an upper distribution disc 26, a lower distribution disc 27, a funnel-like portion-containing disc 28 and a spinneret orifice-containing disc 29, downstream wise. In this spinneret 60, the portion of the upper distribution disc 26 and that of the lower distribution disc 27 which contain rows of openings serve also as the nozzle plates 1 and 1', respectively.

FIG. 10 shows an overall view of the spinneret 60, in which the left half is a simple vertical cross section taken along the axis of the spinneret and also along the center of the row of nozzles, whereas the right half is a cross section which is an outward view taken orthogonal to the row of nozzles at a position deviated from the axis of the spinneret. FIG. 11 is a view taken along the line a–a' in FIG. 10 between the upper distribution disc and the lower distribution disc, i.e., the upper surface of the lower distribution disc 26; whereas FIG. 12 is a view taken along the line b–b' in FIG. 10 between the upper distribution disc and the lower distribution disc, i.e. the lower surface of the upper distribution disc 27.

To describe more specifically about this spinneret, FIG. 13(*a*) shows the upper surface of the upper distribution disc 26 shown in FIG. 10; and FIG. 13(*b*) is a vertical cross-sectional view of the same part as described above, i.e. the upper distribution disc. FIG. 14(*a*) shows the upper surface of the lower distribution disc 27 also shown in FIG. 10, whereas FIG. 14(*b*) is a vertical cross-sectional view of the same part, i.e., the lower distribution disc 27. Each pair of these upper and lower distribution discs 26 and 27 contain rows of 12 openings 2 and 2' respectively. Each pair of opening rows constitute one nozzle block. The row of openings 2 in one block is shown in the enlarged view in FIGS. 13 and 14. FIG. 13 shows the row of openings 2 in the upper distribution disc 26, while FIG. 14 shows the row of openings 2' in the lower distribution disc 27.

These rows of openings are arranged such that the openings 2 in the upper distribution disc 26 may oppose the openings 2' in the lower distribution disc 27 via a narrow overflow section such that the former openings are shifted horizontally by ½ pitch from the latter openings. The structure following this narrow overflow section, i.e. the structure on the downstream side of the flow of the molten polymer compounds, is bent once downward at a right angle, with a vertical groove having on the downstream side an expanded channel 21 extending via a sloped portion. On the downstream side of the channel 21, a funnel-like portion 22 having a channel tapering off is formed. Further, on the downstream side of the funnel-like portion 22, an annular groove 23 is formed in the spinneret disc 29 along the boundary with the funnel-like portion-containing disc 28 to surround the funnel-like portion, and the molten polymer supplied to the lower distribution disc 27 is designed to be supplied partly to this groove 23. The groove 23 has on the downstream side a final spinneret orifice 24.

Fibers are spun employing this spinneret 60 as follows. Molten polymer materials A and B are introduced through the inlets 3,3' to the rows of openings defined in the upper distribution disc 26 and the lower distribution disc 27, respectively. The molten polymer material A is injected through the row of openings 2, whereas the molten polymer material B is injected through the row of openings 2', and the polymer materials A and B are laminated with each other immediately after injection. The thus laminated polymer passes through the channel 21 and is reduced in the thickness of each ply by the funnel-like portion 22 of the funnel-like portion-containing disc 28. The polymer materials of the laminar structure passed through this funnel-like portion 22 are covered therearound with the polymer compound material distributed partly from the lower distribution disc 27 and supplied to the groove 23 formed to surround the funnel-like portion to be spun through the final spinneret orifice 24.

Incidentally, in a cross-sectional structure of the composite short fiber as shown in FIG. 1(*b*), when the short fiber is to be fused onto a support under heating, it can be carried out by selecting as the material for covering the laminar structure a material which has a low melting point and does not affect color development as the covering material instead of using one of the materials constituting the fiber, and such fibers can be formed if the structure of the spinneret 60 is modified slightly. That is, an extra inlet for the material to be supplied to the groove 23 is formed, and the material having the properties as described above, including a low melting point etc. may be supplied to the inlet.

Now referring to formation of monofilament, FIG. 16 shows an example of high-speed cutting machine 31 employable for obtaining the short fiber of the present invention. This high-speed cutting machine 31 consists of a delivery device 32, a cutter 35, a product recovery box 37, etc. When the composite fiber is to be cut, a bundle of the composite fiber is further bundled into the form of cord or plate to provide a fiber bundle, and then a roll of the fiber bundle is set in the delivery device 32. The fiber bundle set in the delivery device 32 is then fed out via feed rollers 33 and a guide 34 to the cutter 35 to be cut into particles with a predetermined size. The thus obtained fiber particles are sucked by a suction pump 38 to be recovered into the product recovery box 37. The fiber particles thus recovered are the short fiber of the present invention. The structure of the cutting machine employable here may not be limited to the structure described above, but any known cutting machines which are capable of cutting fibers can suitably be employed.

When composite fibers are to be cut using such a high-speed cutting machine as illustrated in FIG. 16, it is efficient to cut a bundle of fiber filaments, e.g., several thousands to several tens of thousands, occasionally several hundreds of thousands of filaments instead of cutting them singly, and thus the fibers can be cut with high accuracy. To describe the manner of bundling the composite fibers, it is common to bundle them into the form of cord or plate, and while both cords and plates can be employed in the present invention, they involve both merits and demerits respectively. Although the fibers can be bundled into the form of cord easily, the cutting accuracy is lowered if a large number of the fibers are to be cut, and the bundle of fibers as such exhibits low rigidity. There are countermeasures for improving this drawback, for example, the bundle of fibers are fixed with one another with a water-soluble glue and dried so as to be able to withstand the delivery strength. Meanwhile, according to the technique of bundling the fibers into the form of plate, it is possible to bundle a large number of fibers and to cut the fibers with high accuracy. However, extra jigs and the like are required for forming plate-like bundles. The manner of bundling may not be limited to those as described above, but any of the known methods which are suitable for cutting fibers are employable.

To describe a typical example of the technique of obtaining a large amount short fiber described above will be explained below specifically referring to FIG. 15. As shown in FIG. 15(*a*), first, 20 pieces of bobbins 41 are each wound with a 105-denier color-developing composite fiber yarn, and these 20 fiber yarns are taken up together by another bobbin 42 to form a 2100-deneir doubling. Further, 15 pieces of bobbins 42 each having the 2100-denier doubling wound therearound are provided, and then the doublings are taken up by 100 times by a hank winder 43 to provide a 31500-denier doubling. The 100-time wound loop-like hank of the doubling on the hank winder is cut open orthogonal to the rotational direction of the hank winder to be straightened and obtain a thick cord 44 of 3,150,000 denier. This cord 44 is fed to a cutting machine 45 to be cut into pieces with a predetermined length with the cutter 45, and thus a great number of cut fiber 46 can be obtained by one cutting motion, enabling efficient formation of color-developing composite short fiber.

(2) Measurement of the Length of Short Fiber

Forty filament bundles each consisting of 11 filaments of violet composite fiber having flat cross-sections were put together and were further bundled into the form of cord and fixed with a water-soluble glue to provide a cord-like fiber bundle which was then fed to a high-speed cutting machine, as shown in FIG. 16, to be cut therewith. The preset cutting width and the measured cutting width are as follows.

Results of size measurement

| Present cutting width | Measured cutting width (mean) |
|---|---|
| 0.5 (mm) | 0.47 (mm) |
| 0.1 | 0.08 |
| 0.05 | 0.04 |
| 2.0 | 2.05 |
| 10 | 10.0 |
| 40 | 39.5 |
| 80 | 80.7 |

(3) Adhesion of Short Fiber onto Support

When the short fiber having a length of about 0.5 mm obtained in this example was sprinkled over a black panel and fixed with a glue to observe its color, the short fiber developed the violet color more intensively compared with the uncut long fiber. The reason is that the short fiber obtained by cutting the long fiber can be dispersed uniformly over the panel and that the fiber can be oriented so that the reflection and interference faces may be arranged along the panel surface with not torsion or bending. Consequently, unlike the long fibers, the short fiber undergoes no reduction of the reflected light which can occur when the fiber particles are overlapped one another, and occurrence of distorted reflection and interference faces can be avoided, thus obviating deterioration of chromaticity. Accordingly, the reflection and interference faces in the short fiber according to the present invention are not of those induced by torsion and the like. It was also successful to reduce orientation of the side faces which are non-reflection and interference faces to face forward.

FIG. 17 shows examples of color-developing structures obtained using the short fiber of the present invention so as to help easy understanding of the utilization of the short fibers of the present invention and characteristics in forming the color-developing structures of the present invention, and contain duplicates of pictures showing black panels on which short fibers are adhered with an adhesive; in which FIG. 17(*a*) shows a black panel on which the short fiber is dispersed over the entire surface; FIG. 17(*b*) shows a black panel on which an adhesive is applied patternwise with the short fiber being dispersed on the adhesive layer; and FIG. 17(*c*) shows an embroidered pattern formed using yarns of the composite fiber structures for the purpose of comparison.

(4) Preparation of Optical Coating Material

When the short fiber having a length of about 2 mm was mixed with a coating material and the resulting mixture was sprayed against an object, the coating film formed presented a face having transparency and high reflectance.

(5) Preparation of Nonwoven Fabric

The process for preparing a nonwoven fabric will first be described below specifically referring to FIG. 18. Filaments of composite fiber prepared are crimped using crimper rollers 51, and the crimped filament are cut with a cutter 52 of a cutting machine into pieces having a length of 3 to 5 cm to give crimped short fiber. The mass of short fiber obtained was subjected to opening using a card to form a fleece-like laminar sheet, as shown in FIG. 18(*c*). This laminar sheet is then subjected to needle punching so as to allow the short fiber pieces to be intertwined and bound with one another, as shown in FIG. 18(*d*). This needle punching is carried out using needles 53 or water, followed by embossing treatment by pressing the thus treated laminate between embossing rollers 54 to achieve both embossing and thinning of the intertwined laminar sheet to give a nonwoven fabric as a final product.

In the present invention, the composite fiber was crimped before cutting and then cut into pieces having a length of about 10 mm, the short fiber thus obtained was used for forming a nonwoven fabric by going through the steps as shown in FIG. 18. As a result, a nonwoven fabric having transparency and high reflectance was obtained.

What is claimed is:

1. A color-developing composite short fiber capable of reflecting visible rays and interfering with said visible rays, comprising:

a first layer of a first polymer compound, said first polymer compound having a first refractive index;

a second layer of a second polymer compound laminated to the first layer, said second polymer compound having a second refractive index, said second refractive index being different from the first refractive index; and said short fiber having a length of 0.01 to 100 mm and having a cross section orthogonal to a longitudinal direction of the short fiber, said cross section having two linear opposed sides.

2. A color-developing structure comprising the color-developing composite short fiber as set forth in claim 1 and a support member having a surface, said short fiber being adhered to the surface of the support member.

3. The color-developing structure according to claim 2, wherein the support member is formed from a metal, a wood, a plastic, a rubber, a ceramic, a paper, a fiber, a glass or mixtures thereof.

4. The color-developing structure according to claim 2, wherein the support member is a sheet, film or plate.

5. The color-developing structure according to claim 3, wherein the support member is a sheet, film or plate.

6. A color-developing structure comprising at least two color-developing short fibers as set forth in claim 1 wherein the short fibers are bonded to one another.

7. A color-developing structure comprising at least one color-developing short fiber as set forth in claim 1 and a fabric material, said short fiber being bonded to said fabric material.

8. The color-developing structure according to claim 6, wherein the short fibers are bonded to each other by adhesion or heat fusion.

9. The color-developing structure according to claim 7, wherein the short fiber is bonded to the fabric material by adhesion or heat fusion.

10. The color-developing composite short fiber according to claim 1, said first polymer compound encapsulating the first and second layers and forming the entire exterior surface of the short fiber.

11. A color developing structure comprising at least one short fiber according to claim 1 and a sheet having a first surface, said at least one short fiber being on the first surface of the sheet.

12. The color developing structure according to claim 11, said first surface of the sheet having a wavy contour.

13. The color developing structure according to claim 11 further comprising a protective layer in contact with the first surface of the sheet.

14. The color developing structure according to claim 11 wherein the sheet further comprises a second surface opposite the first surface and an adhesive, said adhesive being on the second surface of the sheet.

15. A color-developing composite short fiber capable of reflecting visible rays and interfering with said visible rays, comprising:

a first layer of a first polymer compound, said first polymer compound having a high refractive index;

a second layer of a second polymer compound laminated to the first layer, said second polymer compound having a low refractive index; and said short fiber having a length of 0.01 to 100 mm and having a cross section orthogonal to a longitudinal direction of the short fiber, said cross section having two linear opposed sides.

16. The color-developing short fiber as set forth in claim 1, said two linear opposed sides of said cross section being parallel.

* * * * *